United States Patent [19]

Liu et al.

[11] 3,997,433

[45] Dec. 14, 1976

[54] METHOD AND APPARATUS FOR GENERATING DRY DUST PARTICLES

[76] Inventors: Benjamin Y. H. Liu, 3005-36th Ave., NE., Minneapolis, Minn. 55418; Virgil A. Marple, 35 N. Teakwood Lane, Minneapolis, Minn. 55441

[22] Filed: July 18, 1975

[21] Appl. No.: 597,235

[52] U.S. Cl. ..... 209/5; 209/144; 209/20; 209/499; 302/51; 302/57; 222/194; 34/10; 34/57 A

[51] Int. Cl.[2] ..... B03B 1/00

[58] Field of Search ..... 209/1, 144, 20, 5, 133, 209/143, 461, 469, 474–476, 138, 139 R, 497, 499; 302/51, 57, 40, 45; 222/193, 194, 371; 356/207; 73/28; 55/102; 34/10, 57 A, 57 R

[56] References Cited

UNITED STATES PATENTS

| | | | |
|---|---|---|---|
| 2,363,473 | 11/1944 | Ryder | 356/207 X |
| 2,711,387 | 6/1955 | Matheson et al. | 209/474 X |
| 2,774,661 | 12/1956 | White | 209/474 X |
| 2,992,758 | 7/1961 | Hayford et al. | 222/193 |
| 3,031,080 | 4/1962 | Lapple | 209/144 |
| 3,134,513 | 5/1964 | Ashman | 222/193 |
| 3,244,325 | 4/1966 | Lindquist | 222/371 X |
| 3,351,759 | 11/1967 | Rich | 55/102 X |
| 3,412,898 | 11/1968 | Marynowski | 209/5 X |
| 3,760,990 | 9/1973 | Lindquist | 222/371 |

*Primary Examiner*—Frank W. Lutter
*Assistant Examiner*—Ralph J. Hill
*Attorney, Agent, or Firm*—Burd, Braddock & Bartz

[57] ABSTRACT

A method and apparatus for generating dry dust particles of a constant concentration from dry solid particles. The apparatus has a dust dispersion section receiving powdered material from a dust feeding section. The dust dispersion section includes a bed of beads subjected to a constant supply of air. An endless chain delivers a continuous supply of powdered material to the bed of beads and the air moving through the bed of beads. The chain is scrubbed by the beads and the air whereby the particles of powdered material are dispersed and entrained in the moving air. The particles move through a tube and are electrically neutralized with a radioactive source. A particle separator can be used to remove large particles. A photometer monitors the concentration of the particles emanating from the apparatus in aerosol form.

41 Claims, 7 Drawing Figures

MOTOR
AIR PUMP

METHOD AND APPARATUS FOR GENERATING DRY DUST PARTICLES

BACKGROUND OF INVENTION

It is desirable in the study of aerosols to generate dust aerosols from a substantance initially in powder form. The powder should be dispersed into the carrier gas stream and all powder particles sould appear in the gas stream as single particles rather than agglomerates of two or more particles. The concentration of particles in the gas stream should be constant with respect to time so that a steady dust stream can be obtained. Dust generators can be used to generate airborne dust from pulverized coal and other mineral and non-mineral substances for testing dust measuring and collecting equipment. Alternatively, the dust generator can be used in animal-exposure experiments where the toxicity of the inhaled dust particles can be assessed.

A number of instruments have been used to generate dust aerosols. Several dust generators have been reported in literature. Wright in the *Journal of Scientific Instruments*, 27:1, January, 1950, p. 12, discloses a dust generator wherein the particles are scraped from a rotating cylinder which has been packed with particles. The particles are picked up by a scraper and are made airborne by a flowing air stream passing through the scraper inlet. The particles moving with the air pass through a nozzle and impact on a plate to break up the agglomerates. This type of dust generator has the disadvantage of not providing a steady dust output since the column of powder must be packed to the same uniform density in order to achieve a steady output. Since uniform loading of the cylinder is difficult to obtain, the dust will appear in puffs rather than a steady stream. Also, the powder is not always steadily dispersed and the particles do not always appear as single individual particles.

Another form of the dust generator uses a groove in a rotating circular disc. The powder is packed into the groove and subsequently picked up by a jet of air as the groove rotates with respect to an air nozzle.

A dispersion-type generator described by Willeke et al in *Aerosol Science*, Volume 5, 1974, pages 449–455, uses a fluidized bed to disperse the powder particles. The powder particles are picked up by a gas stream flowing up through the fluidized bed. The powder to be dispersed is either premixed in the bed material or introduced into the fluidized bed. The dust dispersion is good but steady operation of the generator cannot be attained.

SUMMARY OF INVENTION

The invention relates to a method and apparatus for mixing particles of powdered material with a moving gas, as air. The apparatus has a housing providing a chamber holding a bed of beads comprising a plurality of separate beads. Powdered material is continuously fed into the chamber with a moving endless chain. Gas moving through the chamber fluidizes the bed of beads and removes the powdered material from the chain. The powdered material particles are entrained in the moving gas and flow through a passage and monitoring chamber. Radioactive source material located in the passage functions to neutralize the charge on the particles. Monitoring means functions to sense the concentration of particles moving through the monitoring chamber. Means, as a cyclone separator, may be used to separate large sized particles from the particles moving through the passage to the monitoring chamber.

An object of the invention is to provide an apparatus operable to continuously generate dust particles of a constant concentration from powdered material. Another object of the invention is to provide an apparatus having a fluidized bed of beads for generating dust particles with means operable to continuously feed powdered material into the fluidized bed of beads. A further object of the invention is to provide a method for continuously generating dust particles of a constant concentration from powdered material.

IN THE DRAWINGS

Figures 1, 2, 6:
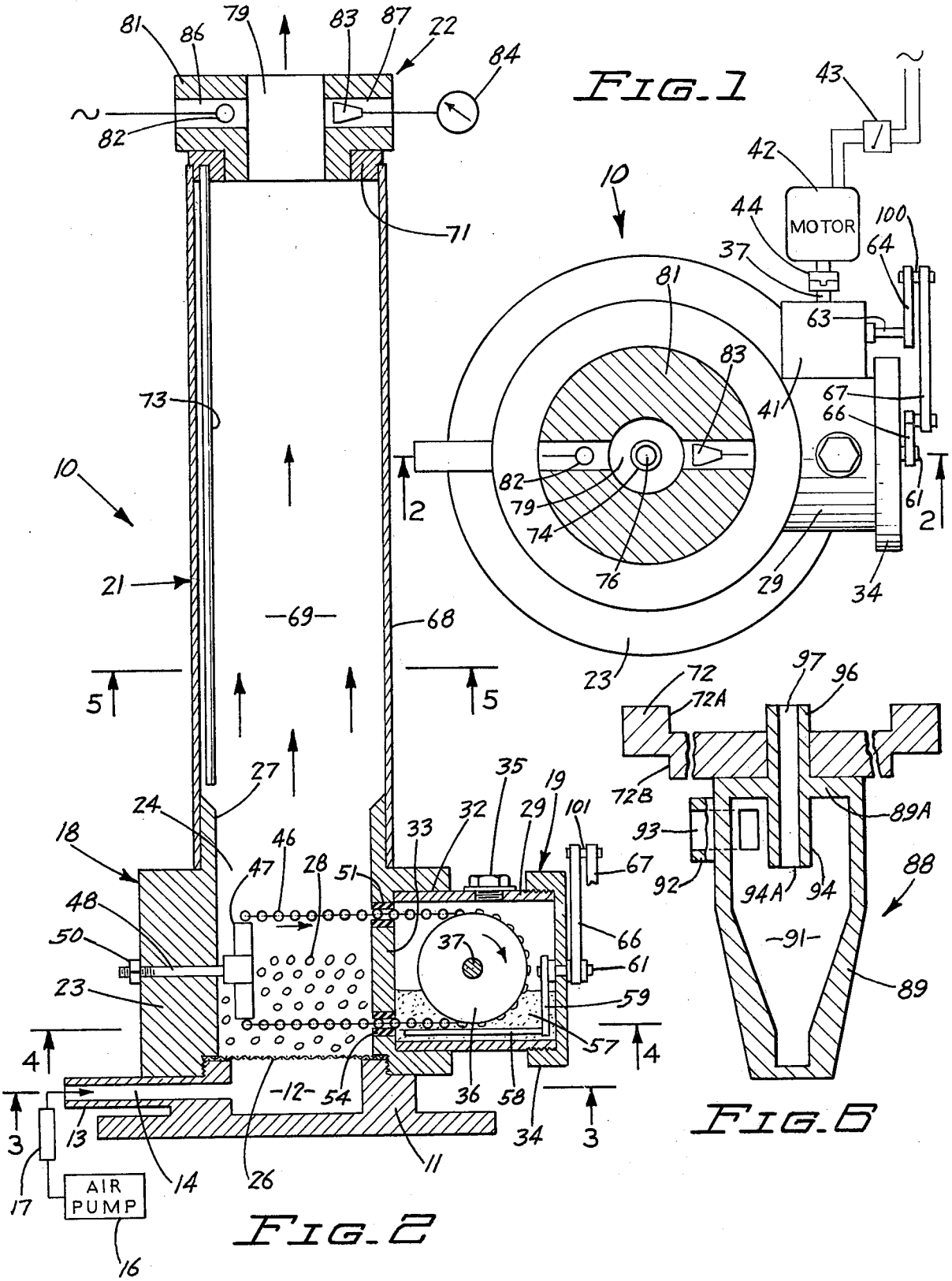
FIG. 1 is a top plan view, partly sectioned, of the apparatus for generating dry particles of the invention.
FIG. 2 is a sectional view taken along line 2—2 of FIG. 1.
FIG. 6 is an elevational sectional view of a particle separator usable with the apparatus of FIG. 2.

DESCRIPTION OF PREFERRED EMBODIMENTS:

Referring to FIGS. 1 and 2, there is shown the apparatus for generating dry dust particles of the invention indicated generally at 10. Apparatus 10 functions to generate dry dust particles of a constant concentration from dry dust particles in powder form. The particles are dispersed in a carrier gas and are discharged from the apparatus in aerosol form. Apparatus 10 has a base 11 having an internal gas plenum chamber 12. A nipple 13 extends laterally from the base and is adapted to accommodate a tube or line (not shown) for carrying gas. Nipple 13 has a passage 14 open to chamber 12. A gas pump 16 is used to move gas through a filter 17 coupled with a line to nipple 13. The pump 16 operates to deliver a constant supply of gas to the plenum chamber 12. This gas can be air.

Apparatus 10 has a dust dispersion section indicated generally at 18 operatively associated with base 11. A dust feeding section indicated generally at 19 is operable to move particles of powdered material into the dust dispersion section 18. The particles move from the dust dispersion section 18 into an elutriation and neutralization section indicated generally at 21. The dust particles entrained in the moving gas move through section 21 into the dust concentration monitoring section indicated generally at 22 which discharges the dust in aerosol form to a desired location.

A body 23 forming a cylindrical housing having a passage 24 is mounted on the base 11. A screen 26 is interposed between body 23 and base 11 to separate the plenum chamber 12 from the passage 24. Passage 24 forms a dust dispersion chamber. Body 23 has an annular top flange 27 providing an extension for the passage 24.

A bed of generally spherical beads 28 are located in passage 24. The beads cover the screen 26. The beads 28 are heavier than the dust particles and function to disperse the dust particles in the fluidizing air which moves through passage 24. Beads 28 can be spherical solids of glass, bronze, brass, nickel or other metals.

Dust feeding section 19 includes a housing 29 having a chamber 31. One end of housing 29 is mounted on body 23. Body 23 has a wall portion 33 that separates the chamber 31 from passage 24. The outer end of housing 29 is closed with a cover 34. A cap 35 is threaded into a hole in housing 29. When cap 35 is removed, the hole is open whereby powdered materials can be placed in chamber 31.

Figure 3:
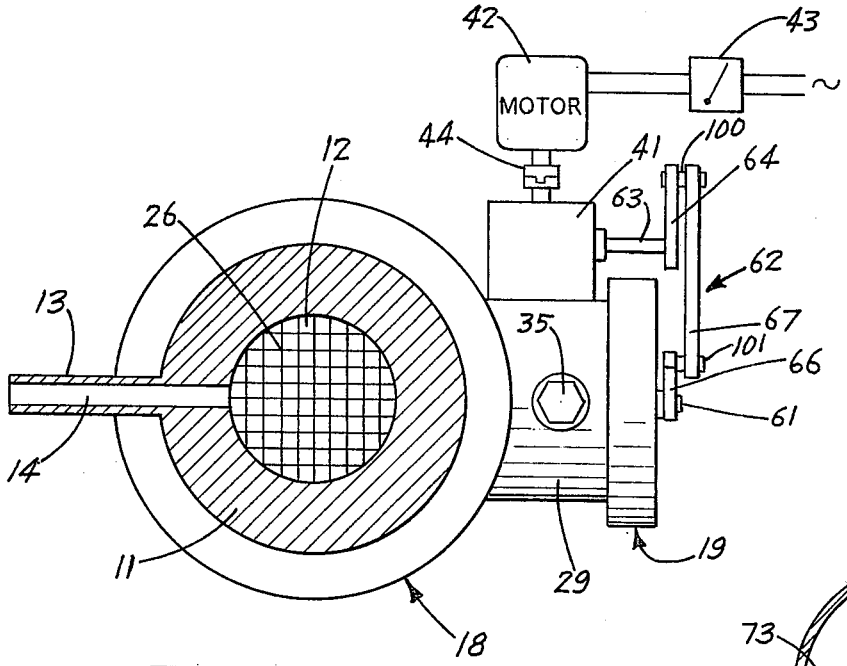
FIG. 3 is a sectional view taken along line 3—3 of FIG. 2.
Figure 5:
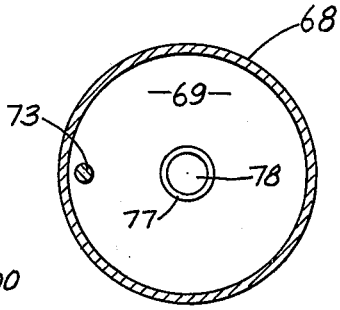
FIG. 5 is a sectional view taken along line 5—5 of FIG. 2.
Figure 4:
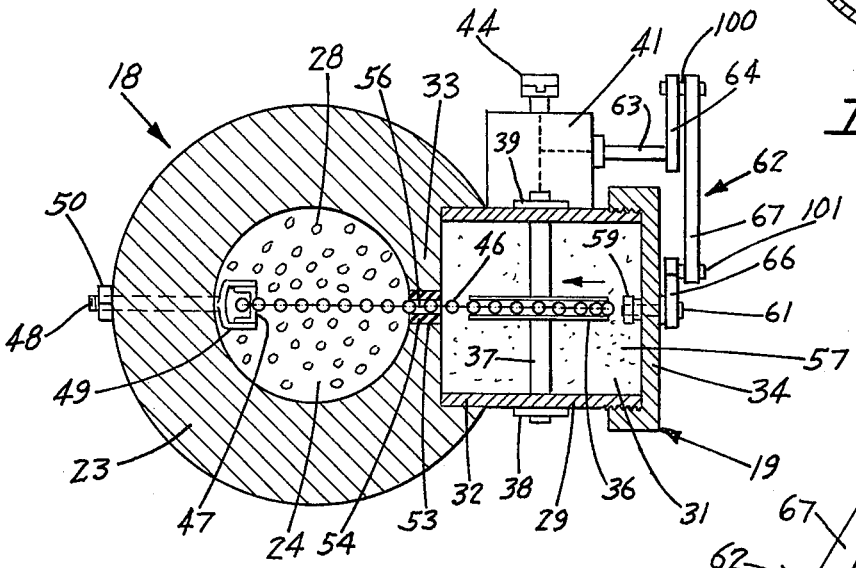
FIG. 4 is a sectional view taken along line 4—4 of FIG. 2.

A wheel 36 secured to a transverse shaft 37 is located in chamber 31. As shown in FIG. 4, opposite ends of the shaft 37 are rotatably mounted on bearings 38 and 39 secured to the housing 29. Shaft 37 is connected to a gear box 41, such as a power transmission or speed reducer, operable to rotate shaft 37. As shown in FIGS. 1 and 3, an electric motor 42 is connected to a power source with a switch 43 or means to vary the speed of the motor. A coupling 44 drivably connects motor 42 with gear box 41. On operation of motor 42, the gear box functions to drive the shaft 37 and thereby rotate wheel 36.

An endless link chain 46 is trained about wheel 36. Chain 46 is a bead chain having a plurality of spherical members connected together with linear wire-like members. Other types of chains can be used in lieu of the bead chain 46. Chain 46 extends from chamber 31 into the passage 24. An upright guide 47 having a generally U-shaped configuration accommodates a portion of chain 46. The guide 47 has a channel facing away from wheel 36 which accommodates an upright portion of chain 46. A bolt 48 extended through a hole in the body 23 has a yoke 48 secured to the guide 47. A nut 50 threaded on the outer end of bolt 48 holds the guide 47 in a fixed upright position and applies tension on chain 46.

The upper run of chain 46 moves through a top hole 51 in wall 33. Hole 51 can have a sleeve lining. The lower or bottom run of chain 46 moves through a flexible lining or sleeve 54 mounted in a hole 53 in wall 33. A lining 54 has a hole 56 slightly smaller than the beads of chain 46. Lining 54 is a flexible material, such as rubber or plastic, and functions to remove excess powder from the chain 46 before the chain enters the dust dispersion passage 24 and forms a seal to prevent beads 28 from entering chamber 31.

Powder material 57, as coal dust, fly ash, rock dust, ultrafine silica and the like, is located in chamber 31. Chain 46, on rotation of wheel 36, is moved in its continuous manner to introduce a continuous supply of powder material into the bottom of passage 24. The air moving through screen 26 agitates or fluidizes the beads 28 and removes the dust particles carried by the chain 46 from the chain and entraines the particles in the moving gas. The upper run of chain 46 moves back into the chamber 31 and around wheel 36 into the powder material, as shown in FIG. 2, to pick up additional material.

Figure 7:
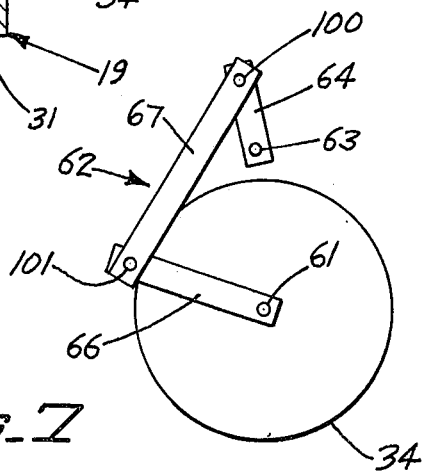
FIG. 7 is a side view of the rake actuation mechanism.

The powdered material 57 is continuously agitated to insure that chain 46 does not form a channel and thus fail to pick up uniform amounts of powdered material. A movable member or rake 58 mounted on arm 59 is located in chamber 31. A rake actuation mechanism is used to move the rake 58 back and forth to agitate the powder material 57. This mechanism has no arm 59 secured to shaft 61 rotatably mounted on the midportion of cover 34. The gearbox 41 is drivably connected with shaft 61 by a four bar linkage system indicated generally at 62 in FIG. 7. The gearbox 41 has an output shaft 63 carrying a first lever or arm 64. A second lever or arm 66 is mounted on shaft 61 with lever 66 being longer than lever 64. A link 67 is connected to levers 64 and 66 with pins 100 and 101. On rotation of shaft 63, and lever 64, a back and forth motion is transmitted to lever 66 and shaft 61. Thus, rake 58 moves back and forth to agitate the powdered material 57 to insure that chain 46 does not form a channel in the powdered material. Other types of drive mechanisms can be used to operate rake 58.

An upright cylindrical tube 68 is mounted on flange 27. Tube 68 has a longitudinal cylindrical passage 69 in communication with passage 24 for carrying the air and particles upwardly to the top of tube 68. A head 71 is mounted on the upper end of tube 68. An elongated cylindrical rod 73 is mounted on head 71 and extends downwardly along one side of passage 69. Rod 73 carries a radioactive source material which functions as a charge neutralizer by making the air surrounding the particles electrically conductive.

Passage 69 has a discharge end open to a chamber 79. Chamber 79 is formed by a passage in a monitor housing 81. Monitor housing 81 is mounted on top of head 71. Monitor housing 81 carries a light source 82 and a photodetector 83. A meter 84 operable to provide a reading of the amount of light sensed by the photodetector 83 is electrically connected to the photodetector. Light source 81 is located in a passage 86. The photodetector 83 is located in a passage 87. Passages 86 and 87 are transversely aligned with each other so that the light emanating from light source 82 is sensed by the photodetector 83. The amount and concentration of the particles moving through chamber 74 is reflected by the amount of light sensed by detector 83 which activates meter 84.

Referring to FIG. 6, there is shown a particle separator indicated generally at 88, as a cyclone separator, for removing large particles from the gas stream moving through the passage 69. In some instances, it is desirable to generate an aerosol with particles in the respirable size. This can be done with the use of a particle separator 88 to remove the large particles from the gas moving through the passage 69. Particle separator 88 has a housing 89 having a cone-shaped chamber 91. A short lateral boss or hub 92 having an inlet passage 93 is attached to the upper end of housing 89. Passage 93 is open to passage 69 and chamber 91 whereby air and particles enter chamber 91 in a tangential direction. The top wall 89A of housing 80 has a first tubular member 94 extended into chamber 91 along the longitudinal axis of the chamber. The lower open end 94A of tubular member 94 is located below the inlet passage 93. A second tubular member 96 extends upwardly from wall 89A. Members 94 and 96 have a common passage 97 for carrying air and particles from chamber 91 to chamber 79. Housing 89 is mounted on a ring 72 having a hole to accommodate member 96. Ring 72 has inside and outside shoulders 72A and 72B to accommodate monitor housing 81 and head 71. When the separator 88 is used, ring 72 is mounted on top of head 71 and monitor housing 81 is mounted on ring 72. Other types of particle separators can be used to remove the larger size particles from the gas stream moving from passage 69.

In use, the pump 16 supplies a continuous source of gas under pressure to the plenum chamber 12. The gas moves through screen 26 and upwardly through beads 28. The chain 46, being continuously driven by wheel 36, carries a continuous supply of particulate material 57 into the passage 24 above the screen 26. The beads 28, being heavier than the dust particles, disperse the particles in the gas moving through passage 24. The velocity of the gas moving through passage 24 is large enough to transport or carry the particles but small enough so that the beads 28 fall back into the lower portion or bed section of passage 24. The chain 46 continuously moves through the powdered material 57 carrying a predetermined amount of material into passage 24. The amount of material is determined by the size of the chain, the type of chain, and the speed of movement of the chain. The flexible lining 54 scrapes the excess powdered material from the chain 46 before the chain enters passage 24 and forms a seal to prevent beads 28 from entering chamber 31.

The upper run of chain 46, as shown in FIG. 2, is above the bed of beads 28. The chain 46 runs upwardly in the U-shaped guide 47 which locates the upper run of the chain 46 in a position where it does not interfere with the dispersion action of beads 28 and the gas moving through the bed of beads 28.

The rake 58 is continuously moved through powdered material 57 to agitate the material. The moving and agitating material prevents the chain from creating a channel in the powdered material 57 so chain 46 will pick up a uniform amount of material between the separated links of the chain. Gearbox 41 operates to simultaneously drive rake 58 and wheel 36 so that the rake 58 is in operation during rotation of the wheel 36. Other types of drives can be used to rotate the wheel 36 and operate rake 58.

The beads 28 and gas moving through chamber 24 remove the powdered material from between the balls or links of the bottom run of the chain 46. The particles of powdered material are separated into individual particles and dispersed into the moving gas. The moving or fluidized bed of beads scrubs the powdered material from the chain and breaks up the agglomerates with the result that the powdered material is in individual particles which move upwardly into the passage 69.

The radioactive material in rod 73 makes the air in the passage 68 electrically conductive. This serves as a charge neutralizer. The particles in passage 69 move upwardly into the monitoring chamber 79. The light from light source 82, as detected by detector 83, monitors the amount and density of the particles moving through chamber 79. The particles leave the chamber 79 in aerosol form.

When particles of a smaller or respirable size are desired, a particle separator 88 can be incorporated to remove the larger size particles. Referring to FIG. 6, the aerosol flow enters the cyclone through inlet 93. Particles larger than the respirable size are removed in the cyclone formed in chamber 91. The smaller particles will move upward through passage 97.

While there have been shown and described the preferred apparatus and method for generating dry dust particles, it is understood that changes in size, materials, and structures can be made by those skilled in the art without departing from the invention.

The embodiments of the invention in which an exclusive property or privilege is claimed are defined as follows:

1. An apparatus for generating particles from powder material comprising: a base having a gas plenum chamber, means for introducing a continuous supply of gas to the plenum chamber, a housing having a first passage mounted on the base, said first passage being open to the plenum chamber, a screen located between the first passage and plenum chamber, a fluidized bed comprising a plurality of beads located in the first passage adjacent the screen, means having a storage chamber for storing powder material, means for moving a continuous stream of powder material from the storage chamber to the portion of the first passage accommodating the beads whereby the powder material comes in contact with the beads tubular means having a second passage in communication with the first passage for carrying gas and particulates derived from the powder material moved into the bed of beads, means including a radioactive source located in the second passage to neutralize the electrical charge of the particulates, and means for monitoring the concentration of particulates entrained in the gas flowing from the second passage.

2. The apparatus of claim 1 wherein: the means for moving a continuous stream of powder material to the first passage includes an endless chain having spaced links, said chain having a portion moving through the chamber storing the powder material to carry a powder material into the portion of the first passage accommodating the beads, said gas moving through the first passage and beads removing the powder material from the chain.

3. The apparatus of claim 2 including: a wheel located in the chamber storing the powder material, said chain being trained about said wheel, and means for rotating said wheel to move the chain through the chamber storing the powder material.

4. The apparatus of claim 3 wherein: the means for rotating the wheels includes a motor and means to vary the speed of the motor.

5. The apparatus of claim 2 including: means located in said chamber storing powder material operable to agitate the powder material.

6. The apparatus of claim 2 wherein: the chain has a lower run moving through said beads and an upper run located above said beads.

7. The apparatus of claim 6 including: wall means separating the first passage from the chamber storing the powder material, flexible means having a hole for accommodating a part of the lower run of the chain, said wall means having a hole for accommodating a part of the upper run of the chain and supporting said flexible means.

8. The apparatus of claim 7 wherein: the flexible means comprises a flexible sleeve mounted in a hole in said wall means.

9. The apparatus of claim 2 including: wall means separating the first passage from the chamber storing the powder material, flexible means having a hole for accommodating one part of the chain, said wall means having a hole for another part of the chain and supporting said flexible means.

10. The apparatus of claim 9 wherein: the flexible means comprises a flexible sleeve mounted in a hole in said wall means.

11. The apparatus of claim 1 including: an elongated rod located in said second passage, said radioactive source being located within said rod.

12. The apparatus of claim 1 wherein: the means for monitoring the concentration of particulates includes a monitoring chamber for carrying a stream of gas and particulates, a light source emitting light energy through said chamber, a light detector for sensing the light energy passing through said monitoring chamber, and means for reading the amount of light energy sensed by the detector.

13. The apparatus of claim 1 including: means for separating large particulates from the gas leaving the second passage.

14. The apparatus of claim 13 wherein: the means for separating the large particulates from the gas comprises a cyclone separator.

15. An apparatus for generating particles from powder material comprising: means having a passage forming a first chamber, a fluidized bed comprising a plurality of separate objects located in the chamber, means having a second chamber for storing powder material, means for feeding a continuous stream of powder material from the second chamber into the fluidized bed whereby the powder material comes in contact with the objects, and means for supplying gas to the first chamber, said gas moving through the fluidized bed to continuously entrain the stream of powder material in the moving gas whereby separate powder particles derived from the powder material are dispersed in and carried by the gas moving from the first chamber.

16. The apparatus of claim 15 wherein: the means for feeding a continuous stream of powdered material into the fluidized bed includes an endless chain having spaced links, said chain having a portion moving through the second chamber to carry powdered material into the first chamber, said gas moving through the fluidized bed being operable to move the powdered material from the chain and entrain the powdered material in the moving gas.

17. The apparatus of claim 16 including: a wheel located in the second chamber, said chain being trained about said wheel, and means for rotating said wheel to move the chain through said first and second chambers.

18. The apparatus of claim 17 wherein: the means for rotating the wheel includes a motor, and means to vary the speed of the motor.

19. The apparatus of claim 16 including: means located in said second chamber operable to agitate the powdered material.

20. The apparatus of claim 16 wherein: the chain has a lower run moving through the fluidized bed and an upper run located above said fluidized bed.

21. The apparatus of claim 16 including: wall means separating the first chamber from the second chamber, flexible means having a hole for accommodating a first part of the chain, said wall means having a hole for accommodating a second part of the chain and supporting said flexible means.

22. The apparatus of claim 21 wherein: the flexible means comprises a flexible sleeve mounted in a hole in said wall means.

23. The apparatus of claim 16 including: wall means separating the first chamber from the second chamber, flexible means having a hole for accommodating a part of the chain, said wall means having a first hole for another part of the chain and a second hole for accommodating the flexible means.

24. The apparatus of claim 23 wherein: the flexible means comprises a flexible sleeve mounted in the second hole.

25. The apparatus of claim 15 including: tubular means having a second passage in communication with the first chamber for carrying gas and particles from the first chamber, means including a radioactive source located in the second passage to neutralize the electrical charge on the particles moving through the second passage.

26. The apparatus of claim 25 including: an elongated rod located in said second passage, said radioactive source being located within said rod.

27. The apparatus of claim 15 including: means for monitoring the concentration of particles entrained in the gas flowing from the first chamber.

28. The apparatus of claim 27 wherein: the means for monitoring the concentration of particles includes a monitoring chamber for carrying a stream of gas and particles, a light source emitting light energy through said chamber, a light detector for sensing the light energy passing through said monitoring chamber, and means for reading the amount of light energy sensed by the detector.

29. The apparatus of claim 15 including: means for separating large particulates from the gas stream leaving the first chamber.

30. The apparatus of claim 29 wherein: the means for separating the large particles from the gas comprises a cyclone separator.

31. A method of generating dust from powder material comprising: moving a chain carrying powdered material into a bed of beads, supplying a stream of gas, and moving said stream of gas through said bed of beads to fluidize the bed of beads and entrain the powdered material in the bed of beads in the moving gas.

32. The method of claim 31 including: continuously moving and endless chain to continuously carry powdered material into the bed of beads.

33. The method of claim 31 including: neutralizing the electrical charge on the particles moving with the gas away from the bed of beads.

34. The method of claim 31 including: monitoring the concentration of particles entrained in the gas flowing from the bed of beads.

35. The method of claim 31 including: separating large size particles from the particles entrained in the gas flowing from the bed of beads.

36. An apparatus for generating particles from powder material comprising: means having a gas plenum chamber, means for introducing a continuous supply of gas to the plenum chamber, a housing having a first passage open to the plenum chamber, a screen located between the first passage and plenum chamber, a bed comprising a plurality of beads located in the first passage above the screen, said bed being in a fluidized state when air moves through the first passage, wall means mounted on the housing having a storage chamber for accommodating powder material, means for moving continuous stream of powder material from the storage chamber to the portion of the first passage accommodating the beads, said means for moving the powder material comprising an endless chain having spaced links, said chain having a lower run movable through the powder material in the storage chamber to carry powder material into the bed of beads and an upper run located above the bed of beads, means mounted on the housing having a second passage in communication with the first passage for carrying gas and particulates derived from the powder material moved into the bed of beads, and means for monitoring the concentration of particulates entrained in the gas flowing from the second passage.

37. The apparatus of claim 36 including: a wheel located in the storage chamber, said chain being trained about said wheel and means for rotating said wheel to move the chain through the storage chamber and the bed of beads.

38. The apparatus of claim 36 including: wall means separating the first passage from the storage chamber, flexible means having a hole for accommodating a part of the chain, said wall means having a first hole for another part of the chain and a second hole accommodating said flexible means.

39. The apparatus of claim 36 wherein: the flexible means comprises a flexible sleeve located in the second hole in said wall means.

40. The apparatus of claim 36 wherein: the means for monitoring the concentration of particles includes a monitoring chamber for carrying a stream of gas and particulates, a light source emitting light energy through said chamber, a light detector sensing the light energy passing through said monitoring chamber, and means for reading the amount of light sensed by the detector.

41. The apparatus of claim 36 including: means for separating large particulates moving in the second chamber from the gas.

* * * * *

UNITED STATES PATENT AND TRADEMARK OFFICE

CERTIFICATE OF CORRECTION

PATENT NO. : 3,997,433

DATED : December 14, 1976

INVENTOR(S) : Benjamin Y. H. Liu et al

It is certified that error appears in the above-identified patent and that said Letters Patent are hereby corrected as shown below:

Column 3, line 52, "entraines" should be --entrains--.

Column 3, line 63, "no" should be --an--.

Column 4, Line 48, "80" should be --89--.

Column 8, Claim 32, line 2, "and" should be --an--.

Signed and Sealed this

Thirty-first Day of May 1977

[SEAL]

*Attest:*

RUTH C. MASON
*Attesting Officer*

C. MARSHALL DANN
*Commissioner of Patents and Trademarks*